US008010020B2

(12) United States Patent
Kita et al.

(10) Patent No.: US 8,010,020 B2
(45) Date of Patent: Aug. 30, 2011

(54) DEVELOPING DEVICE AND IMAGE FORMING APPARATUS EQUIPPED WITH THE SAME

(75) Inventors: Emi Kita, Tokyo (JP); Koichi Kato, Kanagawa (JP); Kiyonori Tsuda, Kanagawa (JP); Yuki Oshikawa, Kanagawa (JP); Susumu Tateyama, Tokyo (JP); Yoshitaka Fujinuma, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 248 days.

(21) Appl. No.: 12/042,848

(22) Filed: Mar. 5, 2008

(65) Prior Publication Data

US 2008/0240792 A1 Oct. 2, 2008

(30) Foreign Application Priority Data

Mar. 29, 2007 (JP) ..... 2007-088406

(51) Int. Cl.
*G03G 15/04* (2006.01)
*G03G 15/08* (2006.01)

(52) U.S. Cl. ..... 399/254; 399/119; 399/222; 399/263

(58) Field of Classification Search ..... 399/254, 399/256, 258
See application file for complete search history.

(56) References Cited

U.S. PATENT DOCUMENTS 5,368,972 A 11/1994 Yamashita et al.
5,495,320 A * 2/1996 Araki et al. ..... 399/256
5,659,860 A 8/1997 Sasaki et al.
5,758,241 A 5/1998 Oyama et al.
5,771,426 A 6/1998 Oka et al.
5,771,429 A 6/1998 Oyama et al.
5,805,965 A 9/1998 Tsuda et al.
5,822,664 A 10/1998 Oka et al.
5,915,155 A 6/1999 Shoji et al.
5,963,766 A * 10/1999 Okuno et al. ..... 399/256
5,987,280 A * 11/1999 Sato et al. ..... 399/119
5,999,772 A 12/1999 Kakitani et al.
6,066,429 A 5/2000 Katoh
6,198,895 B1 3/2001 Tsuda et al.
6,337,957 B1 1/2002 Tamaki et al.
6,522,855 B1 2/2003 Katoh et al.
6,819,897 B2 11/2004 Kita
6,882,817 B2 4/2005 Kita (Continued)

FOREIGN PATENT DOCUMENTS

JP 9-146355 6/1997

(Continued)

*Primary Examiner* — David M Gray
*Assistant Examiner* — Francis Gray
(74) *Attorney, Agent, or Firm* — Oblon, Spivak, McClelland, Maier & Neustadt, L.L.P.

(57) ABSTRACT

The developer conveyance amount on the upstream side of an agitation conveyance path in a developer conveyance direction becomes larger than the amount of developer to be transported from a recovery conveyance path to the agitation conveyance path, by making the developer conveyance amount on the upstream side of an agitating screw in the developer conveyance direction equal to or larger than the developer conveyance amount on the downstream side of a recovery screw in the developer conveyance direction. Accordingly, the bulk of the developer existing on the downstream side of the recovery conveyance path in the developer conveyance direction can be prevented from reaching the level where the recovered developer re-adheres to a developing roller, and further the developer existing on the downstream side of the recovery conveyance path in the developer conveyance direction can be prevented from re-adhering to the developing roller.

6 Claims, 10 Drawing Sheets

U.S. PATENT DOCUMENTS

| | | | | |
|---|---|---|---|---|
| 7,003,255 | B2 | 2/2006 | Kawasumi et al. | |
| 7,024,133 | B2 | 4/2006 | Nagashima et al. | |
| 7,062,207 | B2 | 6/2006 | Tsuda et al. | |
| 7,072,602 | B2 | 7/2006 | Hatori et al. | |
| 7,076,192 | B2 | 7/2006 | Tsuda et al. | |
| 7,123,865 | B2 | 10/2006 | Kita | |
| 7,136,610 | B2 | 11/2006 | Arai et al. | |
| 7,146,122 | B2 | 12/2006 | Hatori et al. | |
| 7,162,189 | B2 | 1/2007 | Tsuda et al. | |
| 7,184,691 | B2 | 2/2007 | Kita et al. | |
| 7,212,753 | B2 | 5/2007 | Suzuki et al. | |
| 7,212,767 | B2 | 5/2007 | Hosokawa et al. | |
| 7,218,879 | B2 | 5/2007 | Enoki et al. | |
| 7,321,744 | B2 | 1/2008 | Hosokawa et al. | |
| 2004/0058260 | A1 | 3/2004 | Katoh et al. | |
| 2005/0226656 | A1 | 10/2005 | Tsuda et al. | |
| 2005/0254846 | A1 | 11/2005 | Yura et al. | |
| 2005/0276632 | A1 | 12/2005 | Ariizumi et al. | |
| 2006/0002743 | A1 | 1/2006 | Katsuyama et al. | |
| 2006/0051136 | A1 | 3/2006 | Tsuda et al. | |
| 2006/0083555 | A1 | 4/2006 | Uchiyama et al. | |
| 2007/0014591 | A1* | 1/2007 | Amano et al. | 399/254 |
| 2007/0077098 | A1 | 4/2007 | Katsuyama et al. | |
| 2007/0081835 | A1 | 4/2007 | Tsuda et al. | |
| 2007/0116494 | A1 | 5/2007 | Uno et al. | |
| 2007/0122204 | A1 | 5/2007 | Kita | |
| 2007/0140747 | A1 | 6/2007 | Kita et al. | |
| 2007/0160392 | A1* | 7/2007 | Tsuda et al. | 399/254 |
| 2007/0166074 | A1 | 7/2007 | Hosokawa et al. | |
| 2007/0177905 | A1 | 8/2007 | Hosokawa et al. | |
| 2007/0212119 | A1 | 9/2007 | Kurenuma et al. | |
| 2007/0264052 | A1* | 11/2007 | Yoshida et al. | 399/254 |
| 2007/0264054 | A1 | 11/2007 | Tsuda et al. | |
| 2007/0274742 | A1* | 11/2007 | Nakayama et al. | 399/254 |
| 2007/0280744 | A1 | 12/2007 | Kubo et al. | |
| 2008/0038021 | A1* | 2/2008 | Tsuda et al. | 399/254 |
| 2008/0085137 | A1* | 4/2008 | Suzuki | 399/254 |
| 2008/0124136 | A1* | 5/2008 | Oshikawa | 399/277 |
| 2008/0205938 | A1* | 8/2008 | Hirose | 399/254 |
| 2008/0247786 | A1* | 10/2008 | Nakayama et al. | 399/274 |
| 2009/0103951 | A1* | 4/2009 | Tsuda | 399/254 |
| 2009/0103953 | A1* | 4/2009 | Tokutake et al. | 399/259 |

FOREIGN PATENT DOCUMENTS

| | | | |
|---|---|---|---|
| JP | 10-177301 | | 6/1998 |
| JP | 11-167260 | | 6/1999 |
| JP | 11167260 | A * | 6/1999 |
| JP | 2004077587 | A * | 3/2004 |
| JP | 2006-243255 | | 9/2006 |
| JP | 2006-251440 | | 9/2006 |
| JP | 2006-251594 | | 9/2006 |
| JP | 2008046240 | A * | 2/2008 |

* cited by examiner

DEVELOPING DEVICE AND IMAGE FORMING APPARATUS EQUIPPED WITH THE SAME

BACKGROUND OF THE INVENTION

1. Field of the Invention

The present invention relates to an image forming apparatus, such as a copying machine, a facsimile device and a printer, and particularly to a developing device using a two-component developer and an image forming apparatus equipped with the developing device.

2. Description of the Related Art

Conventionally, a developing device that uses a two-component developer composed of a toner and a magnetic carrier is provided with, independently, a developer supply conveyance path for supplying the developer to a developing roller serving as a developer carrier, and a developer agitation conveyance path for conveying the developer, so that the developer can be circulated while being conveyed along these two conveyance paths in opposite directions. Such a developing device uses the developer supply conveyance path also as a developer recovery conveyance path for recovering the developer that has passed through a developing region after being supplied to the developing roller and has consumed its toner.

However, if the developer supply conveyance path and the developer recovery conveyance path are used as one conveyance path, a developer that has consumed its toner is mixed in with a developer that has been adjusted to obtain an appropriate toner density so as to be supplied to the developing roller. For this reason, there arises a problem that the toner density of the developer to be supplied to the developing roller is reduced, and thereby the image density at the time of development is reduced.

This problem can be solved by providing the developer supply conveyance path and the developer recovery conveyance path as two different developer conveyance paths, as in the developing device described in, for example, Japanese Published Unexamined Patent Application H11-167260. This developing device is provided with a developer supply conveyance path and a developer recovery conveyance path separately. Moreover, this developing device has a developer agitation conveyance path, which, while agitating a developer that has been conveyed to the lowermost stream side of the developer supply conveyance path in a developer conveyance direction and a recovery developer that has been conveyed to the lowermost stream side of the developer recovery conveyance path in a developer conveyance direction, conveys the developers in a direction opposite to that of the developer supply conveyance path.

However, in such a configuration of this developing device, when a latent image with a small image area ratio is developed, the amount of developer to be recovered by the developer recovery conveyance path is increased, and thereby the amount of recovery developer to be transported from the downstream side of the developer recovery conveyance path to the upstream side of the developer agitation conveyance path is increased. Therefore, when latent images with a small image area ratio are developed continuously, the amount of developer existing on the upstream side of the developer agitation conveyance path increases gradually. When the amount of developer existing on the upstream side of the developer agitation conveyance path increases, the recovery developer to be transported from the downstream side of the developer recovery conveyance path to the upstream side of the developer agitation conveyance path starts flowing slowly, whereby the recovery developer accumulates on the downstream side of the developer recovery conveyance path in the developer conveyance direction. Then, when the bulk of the recovery developer becomes excessively high at the downstream side of the developer recovery conveyance path in the developer conveyance direction due to this accumulation, the recovery developer re-adheres to a developing roller, which is so-called "accompanying phenomenon." When this accompanying phenomenon occurs, the developer which has been used for development and thereby the toner density of which has decreased adheres to the developing roller, hence there arises a problem that the image density of only this adhered part becomes low, causing a white stripe and deteriorating the image quality.

Technologies relating to the present invention are also disclosed in, e.g., Japanese Published Unexamined Patent Application No. 2006-243255.

SUMMARY OF THE INVENTION

The present invention was contrived in view of the above problems, and an object of the present invention is to provide a developing device capable of preventing deterioration of the image quality, which is caused when a recovered developer re-adheres to a developing roller, and an image forming apparatus equipped with the developing device.

In an aspect of the present invention, a developing device comprises a developer carrier, which rotates while carrying a two-component developer composed of a magnetic carrier and a toner on a surface of the developer carrier, supplies the toner to a latent image on a surface of a latent image carrier at a section where the developer carrier faces the latent image carrier, and develops the latent image; a developer supply conveyance path, which conveys the developer in a direction of axis of the developer carrier and is provided with a developer supply conveyance screw for supplying the developer to the developer carrier; a developer recovery conveyance path, which has a developer recovery conveyance screw for conveying the developer recovered from the developer carrier after passing through the section where the developer carrier faces the latent image carrier, in the direction of axis of the developer carrier and in the same direction as a direction of the developer supply conveyance screw; and a developer agitation conveyance path, which supplies the developer to the developer supply conveyance path and which has a developer agitation conveyance screw for receiving a supply of an excess developer conveyed to the lowermost stream side of the developer supply conveyance path in a developer conveyance direction without being used in development, and a recovery developer recovered from the developer carrier and conveyed to the lowermost stream side of the developer recovery conveyance path in the developer conveyance direction, and conveying the excess developer and the recovery developer in the direction of axis of the developer carrier and in a direction opposite to the direction of the developer supply conveyance screw while agitating the excess developer and the recovery developer. The developer agitation conveyance path and the developer recovery conveyance path are provided in parallel with each other on substantially the same level, the developer supply conveyance path is provided so as to be positioned above the other two developer conveyance paths, and the developer conveyance amount on the upstream side of the developer agitation conveyance screw in the developer conveyance direction is equal to or larger than the developer conveyance amount on the downstream side of the developer recovery conveyance screw in the developer conveyance direction.

In another aspect of the present invention, an image forming apparatus comprises a latent image carrier that carries a latent image; and a developing device for developing the latent image on the latent image carrier by means of a developer. The developing device comprises a developer carrier, which rotates while carrying a two-component developer composed of a magnetic carrier and a toner on a surface of the developer carrier, supplies the toner to the latent image on a surface of the latent image carrier at a section where the developer carrier faces the latent image carrier, and develops the latent image; a developer supply conveyance path, which conveys the developer in a direction of axis of the developer carrier and is provided with a developer supply conveyance screw for supplying the developer to the developer carrier; a developer recovery conveyance path, which has a developer recovery conveyance screw for conveying the developer recovered from the developer carrier after passing through the section where the developer carrier faces the latent image carrier, in the direction of axis of the developer carrier and in the same direction as a direction of the developer supply conveyance screw; and a developer agitation conveyance path, which supplies the developer to the developer supply conveyance path and which has a developer agitation conveyance screw for receiving a supply of an excess developer conveyed to the lowermost stream side of the developer supply conveyance path in a developer conveyance direction without being used in development, and a recovery developer recovered from the developer carrier and conveyed to the lowermost stream side of the developer recovery conveyance path in the developer conveyance direction, and conveying the excess developer and the recovery developer in the direction of axis of the developer carrier and in a direction opposite to the direction of the developer supply conveyance screw while agitating the excess developer and the recovery developer. The developer agitation conveyance path and the developer recovery conveyance path being provided in parallel with each other on substantially the same level, the developer supply conveyance path being provided so as to be positioned above the other two developer conveyance paths, and the developer conveyance amount on the upstream side of the developer agitation conveyance screw in the developer conveyance direction being equal to or larger than the developer conveyance amount on the downstream side of the developer recovery conveyance screw in the developer conveyance direction.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT(S)

The prior art and the problems thereof will be described with reference to the drawings before explaining the present invention.

Figure 1:
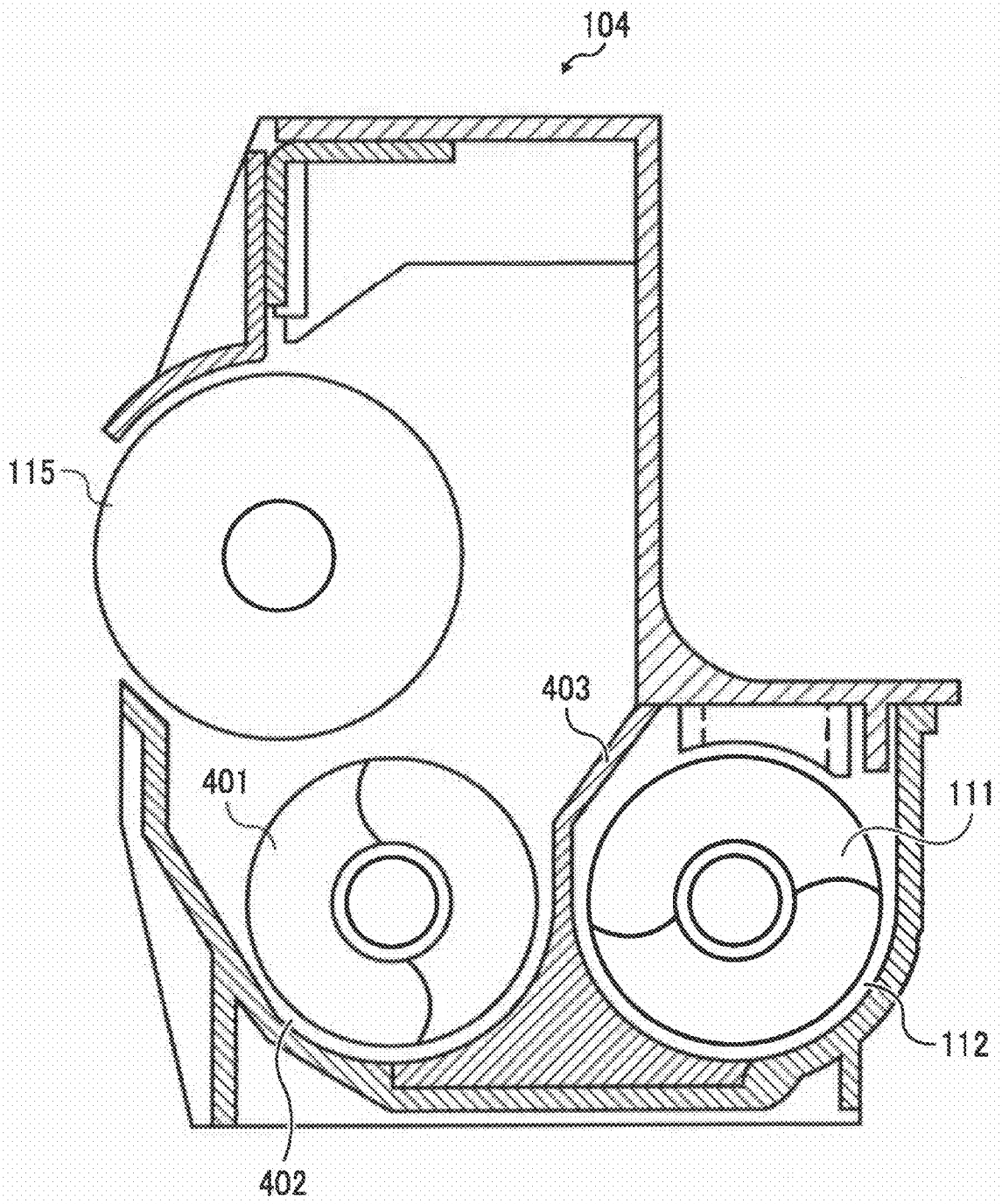
FIG. 1 PRIOR ART
FIG. 1 is a diagram showing a schematic configuration of a conventional developing device that conveys a developer using two conveyance paths.

FIG. 1 shows a conventional developing device that uses a two-component developer composed of a toner and a magnetic carrier. This developing device 104 is provided with, independently, a developer supply conveyance path 402 that supplies the developer to a developing roller 115 serving as a developer carrier, and a developer agitation conveyance path 112 that agitates the developer, wherein the developer is circulated while being conveyed long these two conveyance paths. Also, in this developing device 104, the developer supply conveyance path 402 is used also as a developer recovery conveyance path for recovering a developer that has passed through a developing region after being supplied to the developing roller 115 and has consumed its toner.

However, if the developer supply conveyance path and the developer recovery conveyance path are used as one conveyance path as described above, a developer that has consumed its toner is mixed in with a developer that has been adjusted to obtain an appropriate toner density so as to be supplied to the developing roller. For this reason, there arises a problem that the toner density of the developer to be supplied to the developing roller is reduced, and thereby the image density at the time of development is reduced.

Figure 2:
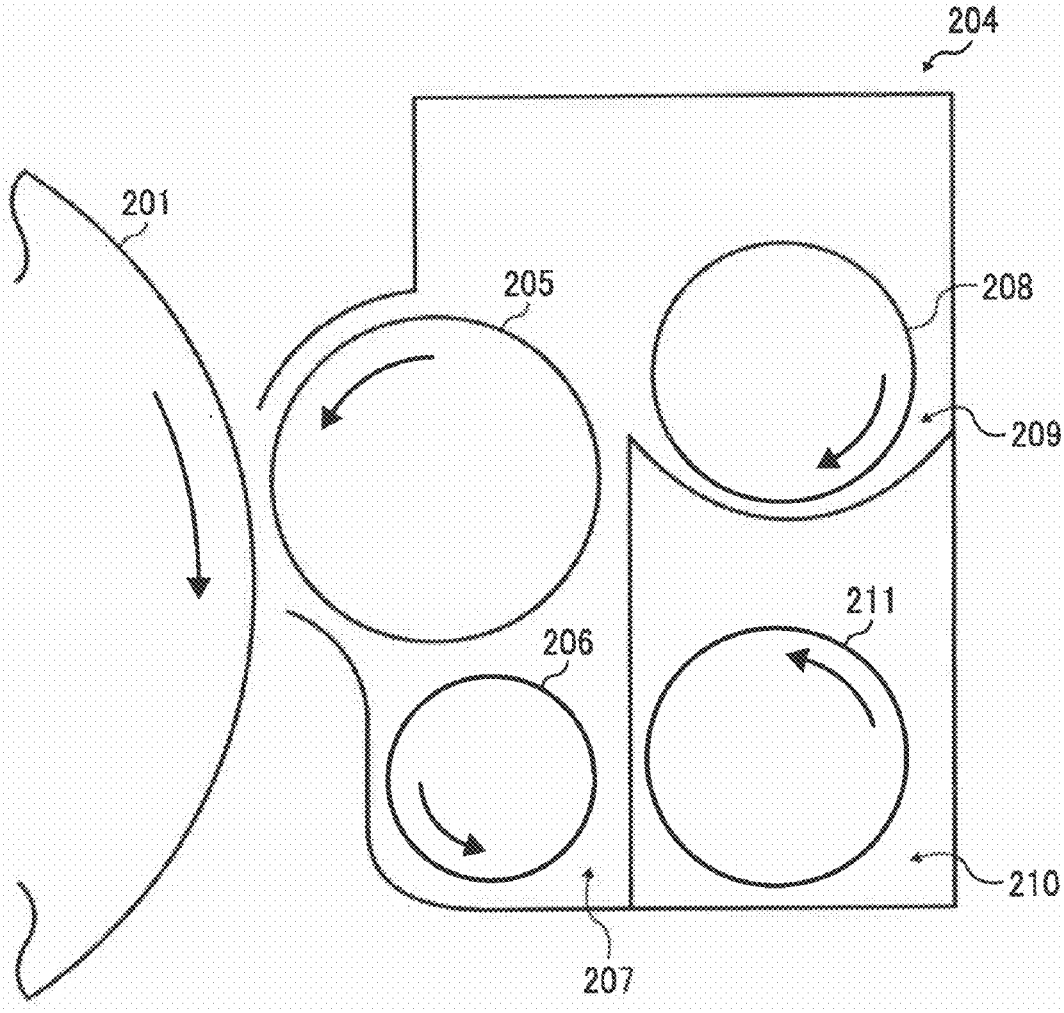
FIG. 2 PRIOR ART
FIG. 2 is a diagram showing a schematic configuration of a conventional developing device that conveys a developer using three conveyance paths.

This problem can be solved by providing the developer supply conveyance path and the developer recovery conveyance path as two different developer conveyance paths, as in the developing device described in the abovementioned Japanese Published Unexamined Patent Application H11-167260. This developing device 204 is provided with a developer supply conveyance path 209 and a developer recovery conveyance path 207 separately, as shown in FIG. 2. Moreover, this developing device 204 has a developer agitation conveyance path 210, which, while agitating a developer that has been conveyed to the lowermost stream side of the developer supply conveyance path 209 in a developer conveyance direction and a recovery developer that has been conveyed to the lowermost stream side of the developer recovery conveyance path 207 in the developer conveyance direction, conveys the developers in a direction opposite to that of the developer supply conveyance path 209. In this developing device 204, because the developer that has been used for developing a latent image formed on a photoreceptor 201 is sent to the developer recovery conveyance path 207, the developer that has been used for development is not mixed into the developer supply conveyance path 209. Therefore, the toner density of the developer within the developer supply conveyance path 209 is not changed and the toner density of the developer supplied to the developing roller 205 also stays constant.

Moreover, the recovery developer is not supplied immediately to the developer supply conveyance path 209 but is supplied to the developer supply conveyance path 209 after agitating it in the developer agitation conveyance path 10, so that the sufficiently agitated developer can be supplied to the developer supply conveyance path 209. Accordingly, irregularity in the image density at the time of development and decrease in the image density, which are the problems generated in the developing device 104 shown in FIG. 1, can be prevented.

However, in such a configuration of this developing device, as described above, when a latent image with a small image area ratio is developed, the amount of developer to be recovered by the developer recovery conveyance path 207 is increased, and thereby the amount of recovery developer to be transported from the downstream side of the developer recovery conveyance path 207 to the upstream side of the developer agitation conveyance path 210 is increased. Therefore, when latent images with a small image area ratio are developed continuously, the amount of developer existing on the upstream side of the developer agitation conveyance path 210 increases gradually. When the amount of developer existing on the upstream side of the developer agitation conveyance path 210 increases, the recovery developer to be transported from the downstream side of the developer recovery conveyance path 207 to the upstream side of the developer agitation conveyance path 210 starts flowing slowly, whereby the recovery developer accumulates on the downstream side of the developer recovery conveyance path 207 in the developer conveyance direction. Then, when the bulk of the recovery developer becomes excessively high at the downstream side of the developer recovery conveyance path 207 in the developer conveyance direction due to this accumulation, the recovery developer re-adheres to the developing roller 205, which is so-called "accompanying phenomenon." When this accompanying phenomenon occurs, the developer which has been used for development and thereby the toner density of which has decreased adheres to the developing roller 205, hence there arises a problem that the image density of only this adhered part becomes low, causing a white stripe and deteriorating the image quality.

In the present invention, the recovery developer changes its direction significantly from the downstream side of the developer recovery conveyance path in the developer conveyance direction and is then transported to the upstream side of the developer agitation conveyance path in the developer conveyance direction. Therefore, the developer conveyance amount on the upstream side of a developer agitating screw in the developer conveyance direction is made equal to or larger than the developer conveyance amount on the downstream side of the developer recovery screw in the developer conveyance direction, whereby the developer conveyance amount on the upstream side of the developer agitation conveyance path in the developer conveyance direction can be made larger than the amount of developer to be transported from the developer recovery conveyance path to the developer agitation conveyance path. Accordingly, because the amount of developer existing on the upstream side of the developer agitation conveyance path in the developer conveyance direction becomes low, the recovery developer can be delivered smoothly from the downstream side of the developer recovery conveyance path in the developer conveyance direction to the upstream side of the developer agitation conveyance path in the developer conveyance direction. Specifically, the recovery developer can be transported smoothly from the downstream side of the developer recovery conveyance path to the upstream side of the developer agitation conveyance path such that the bulk of the recovery developer existing on the downstream side of the developer recovery conveyance path in the developer conveyance direction does not increase to the level where the recovery developer re-adheres to the developer carrier. Consequently, since the bulk of the recovery developer existing on the downstream side of the developer recovery conveyance path in the developer conveyance direction does not reach the abovementioned level, the recovery developer can be prevented from re-adhering from the developer recovery conveyance path to the developer carrier. Therefore, the developer carrier can develop a latent image formed on a latent image carrier by using only the developer supplied from the developer supply conveyance path.

As an image forming apparatus to which the present invention is applied, an embodiment of a tandem color laser copying machine (simply called "copying machine" hereinafter) in which a plurality of photoreceptors are disposed in parallel with each other will be described below.

Figure 3:
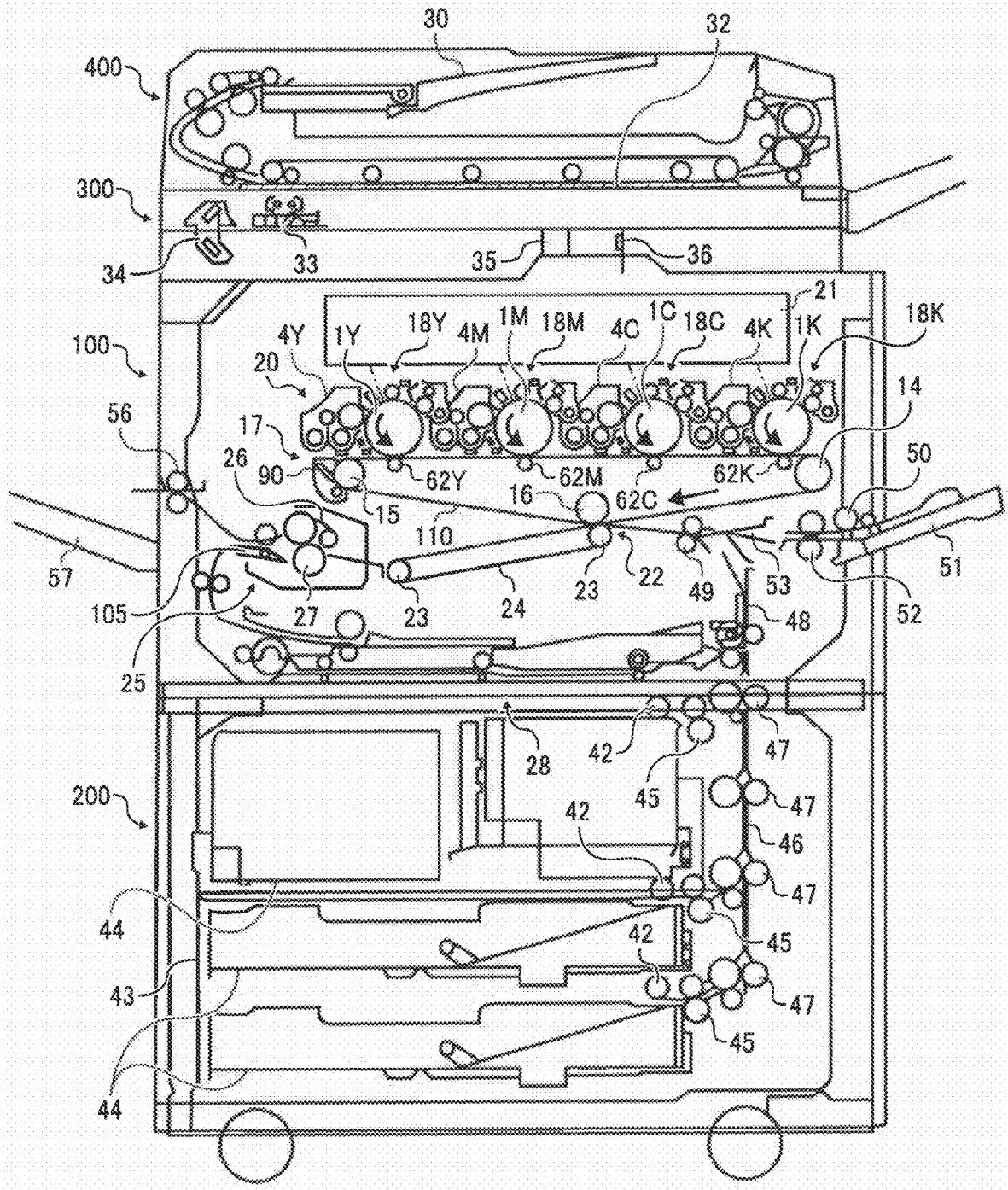
FIG. 3 is a diagram showing a schematic configuration of a copying machine according to an embodiment of the present invention.

FIG. 3 shows the schematic configuration of the copying machine according to the present embodiment. This copying machine has a printer portion 100, a sheet feeding device 200 on which the printer portion 100 is placed, a scanner 300 placed fixedly on the printer portion 100, and the like. The copying machine further has an automatic original conveying device 400 that is placed fixedly on the scanner 300.

The printer portion 100 has an image forming unit 20 that is constituted by four process cartridges 18Y, M, C and K for forming images of yellow (Y), magenta (M), cyan (C), and black (K) respectively. The letters Y, M, C and K provided at the ends of the reference numerals indicate the members for the colors, yellow, cyan, magenta and black, respectively (same hereinafter). An optical writing unit 21, an intermediate transfer unit 17, a secondary transfer device 22, a resist roller pair 49, a belt fixing type fixing device 25 and the like are disposed besides the process cartridges 18Y, M, C and K.

The optical writing unit 21 has a light source, a polygon mirror, an f-θ lens, a reflecting mirror and the like that are not shown, and emits a laser beam onto the surface of an after-described photoreceptor on the basis of image data.

Each of the process cartridges 18Y, M, C and K has a drum-like photoreceptor 1, a charging unit, a developing device 4, a drum cleaning device, a destaticizing unit, and the like.

The yellow process cartridge 18 will be described hereinafter.

The surface of a photoreceptor 1Y is uniformly charged by the charging unit functioning as charging means. The surface of the photoreceptor 1Y that is subjected to charging processing is irradiated with a laser beam that is modulated and deflected by the optical writing unit 21. Consequently, the potential of the irradiated portion (exposed portion) is attenuated. Due to this attenuation, a Y electrostatic latent image is formed on the surface of the photoreceptor 1Y. The formed Y electrostatic latent image is developed by a developing device 4Y serving as developing means, whereby a Y toner image is obtained.

The Y toner image formed on the Y photoreceptor 1Y is primarily transferred to an intermediate transfer belt 110 described hereinafter. Transfer residual toner on the surface of the photoreceptor 1Y is cleaned by the drum cleaning device after the Y toner image is primarily transferred.

In the Y process cartridge 18Y, the photoreceptor 1Y that is cleaned by the drum cleaning device is destaticized by the destaticizing unit. Then, the photoreceptor 1Y is uniformly charged by the charging unit and thereby returns to the initial state. The series of processes described above is the same for the other process cartridges 18M, C and K.

The intermediate transfer unit 17 will be described next.

The intermediate transfer unit 17 has the intermediate transfer belt 110, a belt cleaning device 90 and the like. The intermediate transfer unit 17 further has a stretching roller 14, a drive roller 15, a secondary transfer backup roller 16, four primary transfer bias rollers 62Y, M, C and K, and the like.

The intermediate transfer belt 110 is tension-stretched by a plurality of rollers including the stretching roller 14. The intermediate transfer belt 110 is then moved endlessly in a clockwise direction in the drawing by rotation of the drive roller 15 that is driven by a belt drive motor, not shown.

Each of the four primary transfer bias rollers 62Y, M, C and K is disposed in contact with the inner peripheral surface of the intermediate transfer belt 110, and is applied with a primary transfer bias from a power source, not shown. Furthermore, the inner peripheral surface of the intermediate transfer belt 110 is pressed against the photoreceptors 1Y, M, C and K to form primary transfer nips. At each of the primary transfer nips, a primary transfer electric field is formed between each of the photoreceptors 1 and each of the primary transfer bias rollers 62 due to the influence of the primary transfer bias.

The abovementioned Y toner image formed on the Y photoreceptor 1Y is primarily transferred onto the intermediate transfer belt 110 by the influence of the primary transfer electric field or nip pressure. M, C and K toner images formed on the M, C and K photoreceptors 1M, C and K are sequentially superimposed and primarily transferred onto the Y toner image. A four-color superimposed toner image (called "four-color toner image" hereinafter), i.e., the multiple toner image, is then formed on the intermediate transfer belt 110 due to this primary transfer performed by superimposing these toner images.

The four-color toner image that is transferred onto the intermediate transfer belt 110 is secondarily transferred onto a transfer sheet, i.e., a recording body that is not shown, by a secondary transfer nip described hereinafter. Transfer residual toner that remains on the surface of the intermediate transfer belt 110 after the developer passes through the secondary transfer nip is cleaned by the belt cleaning device 90 that holds the belt between this belt cleaning device 90 and the drive roller 15 located on the left side of the drawing.

Next, the secondary transfer device 22 will be described.

The secondary transfer device 22 that stretches a sheet conveying belt 24 by means of two stretching rollers 23 is disposed on the lower side of the intermediate transfer unit 17 as shown. The sheet conveying belt 24 is endlessly moved in a counterclockwise direction in the drawing as at least either one of the stretching rollers 23 is driven and rotated. Of the two stretching rollers 23, the one disposed on the right side in the drawing holds the intermediate transfer belt 110 and the sheet conveying belt 24 between this stretching roller and the secondary backup roller 16 of the intermediate transfer unit 17. Accordingly, the secondary transfer nip where the intermediate transfer belt 110 of the intermediate transfer unit 17 comes into contact with the sheet conveying belt 24 of the secondary transfer device 22 is formed. Then, this stretching roller 23 is applied with a secondary transfer bias having a polarity opposite to the polarity of the toner, by the unshown power source. Due to this application of the secondary transfer bias, a secondary transfer electric field that electrostatically moves the four-color toner image formed on the intermediate transfer belt 110 of the intermediate transfer unit 17 from the belt side toward this stretching roller 23 is formed at the secondary transfer nip. The four-color toner image that is affected by the secondary transfer electric field or nip pressure is secondarily transferred onto the transfer sheet which is sent to the secondary transfer nip by the after-described resist roller pair 49 in synchronization with the four-color toner image formed on the intermediate transfer belt 110. Note that a charger for charging the transfer sheet in a noncontact manner may be provided in place of the secondary transfer system that applies a secondary transfer bias to this stretching roller 23.

In the sheet feeding device 200 provided in a lower part of the copying machine main body, a plurality of sheet feeding cassettes 44, each of which can contain a plurality of stacked transfer sheets, are disposed vertically in a stacked manner. Each of the sheet feeding cassettes 44 presses a sheet feeding roller 42 against the top transfer sheet of the stacked transfer sheets. Then, by rotating the sheet feeding roller 42, the top transfer sheet is sent out toward a sheet feeding path 46.

The sheet feeding path 46 that receives the transfer sheet sent out from the sheet feeding cassette 44 has a plurality of conveying roller pairs 47 and the resist roller pair 49 that is provided in the vicinity of an end of the sheet feeding path 46. The sheet feeding path 46 conveys the transfer sheet toward the resist roller pair 49. The transfer sheet conveyed toward the resist roller pair 49 is sandwiched between the rollers of the resist roller pair 49. On the other hand, in the intermediate transfer unit 17, the four-color toner image formed on the intermediate transfer belt 110 enters the secondary transfer nip as the belt moves endlessly. The resist roller pair 49 sends the transfer sheet sandwiched between these rollers at timing at which the transfer sheet is attached to the four-color toner image at the secondary transfer nip. In this manner, the four-color toner image formed on the intermediate transfer belt 110 is attached to the transfer sheet at the secondary transfer nip. Then, the four-color toner image is secondarily transferred onto the transfer sheet and thereby becomes a full-color image on the white transfer sheet. The transfer sheet on which the full-color image is formed in this manner leaves the secondary transfer nip as the sheet conveying belt 24 moves endlessly, and is then sent from the top of the sheet conveying belt 24 to the fixing device 25.

The fixing device 25 has a belt unit that is caused to move endlessly while stretching a fixing belt 26 by means of two rollers, and a pressure roller 27 that is pressed against one of the rollers of the belt unit. The fixing belt 26 and the pressure roller 27 abut against each other to form a fixing nip, and the transfer sheet received from the sheet conveying belt 24 is sandwiched by this nip. Of the two rollers of the belt unit, the roller that is pressed by the pressure roller 27 has a heat source therein, not shown, and applies pressure on the fixing belt 26 by using heat generated by the heat source. The fixing belt 26 applied with pressure heats the transfer sheet sandwiched by the fixing nip. Due to the application of heat or the nip pressure, the full-color image is fixed onto the transfer sheet.

The transfer sheet that is subjected to fixing processing in the fixing device 25 is either stacked on a stack portion 57 provided on the outside of a plate of a printer casing on the left side of the drawing, or is returned to the abovementioned secondary transfer nip in order to form a toner image on the other side of the transfer sheet.

When making a copy of an original, not shown, for example, a sheaf of sheet originals is set on an original platen 30 of the automatic original conveying device 400. However, if this original is a one-filing original closed by the subject document, the sheaf of sheet originals is set on a contact glass 32. Prior to this setting operation, the automatic original conveying device 400 is opened with respect to the copying machine main body, and thereby the contact glass 32 of the scanner 300 is exposed. Thereafter, the one-filing original is pressed by the closed automatic original conveying device 400.

After the original is set in this manner, an unshown copy start switch is pressed, whereby an original reading operation is performed by the scanner 300. However, if a sheet original is set on the automatic original conveying device 400, the automatic original conveying device 400 automatically moves the sheet original to the contact glass 32 before the original reading operation is performed. When the original reading operation is performed, a first traveling body 33 and a second traveling body 34 start traveling together first, and light is emitted from a light source provided in the first traveling body 33. Then, the light reflected from the surface of the original is reflected by a mirror provided within the second traveling body 34, passes through an image forming lens 35, and thereafter enters a read sensor 36. The read sensor 36 constructs image information based on the reflected light.

In parallel with such original reading operation, each element within each of the process cartridges 18Y, M, C and K, the intermediate transfer unit 17, the secondary transfer device 22, and the fixing device 25 start driving. Then, the optical writing unit 21 is driven and controlled based on the image information constructed by the read sensor 36, and Y, M, C and K toner images are formed on the photoreceptors 1Y, M, C and K respectively. These toner images become a four-color toner image by superimposing and transferring these toner images onto the intermediate transfer belt 110.

Moreover, at substantially the same time as when the original reading operation is performed, a sheet feeding operation is started in the sheet feeding device 200. In this sheet feeding operation, one of the sheet feeding rollers 42 is selected and rotated, and transfer sheets are sent out from one of the sheet feeding cassettes 44 that are stored in multiple stages in a paper bank 43. The sent transfer sheets are separated one by one by a separating roller 45. Each sheet enters a reversal sheet feeding path 46 and is then conveyed to the secondary transfer nip by the conveying roller pairs 47. Sheets are sometimes fed from a manual tray 51 in place of the sheet feeding cassettes 44. In this case, after a manual sheet feeding roller 50 is selected and rotated to send out transfer sheets placed on the manual tray 51, the separation roller 52 separates the transfer sheets one by one and feeds each sheet to a manual sheet feeding path 53 of the printer portion 100.

In the present copying machine, when forming other color image composed of toners of two or more colors, the intermediate transfer belt 110 is stretched such that an upper stretching surface thereof lies substantially horizontally, and all of the photoreceptors 1Y, M, C and K are brought into contact with the upper stretching surface. On the other hand, when forming a monochrome image composed of the K toner only, the intermediate transfer belt 110 is tilted downward to the left in the drawing by using an unshown mechanism, and the upper stretching surface thereof is separated from the Y, M and C photoreceptors 1Y, M and C. Then, out of the four photoreceptors 1Y, M, C and K, only the K photoreceptor 1K is rotated in the counterclockwise direction in the drawing to form a K toner image only. At this moment, for Y, M and C, driving of the photoreceptors 1 thereof and a developing unit is stopped to prevent the photoreceptors and developer from being depleted unnecessarily.

The present copying machine has a control unit, not shown, which is configured by a CPU and the like that control the following elements provided in the copying machine, and an operation display portion, not shown, which is configured by a liquid crystal display, various keybuttons, and the like. An operator can select one of three one-side printing modes for forming an image on one side of a transfer sheet, by sending a command to the control unit based on the implementation of a key input operation in the operation display portion. The three one-side printing modes are a direct discharge mode, a reversal discharge mode, and a reversal decal discharge mode.

Figure 4:
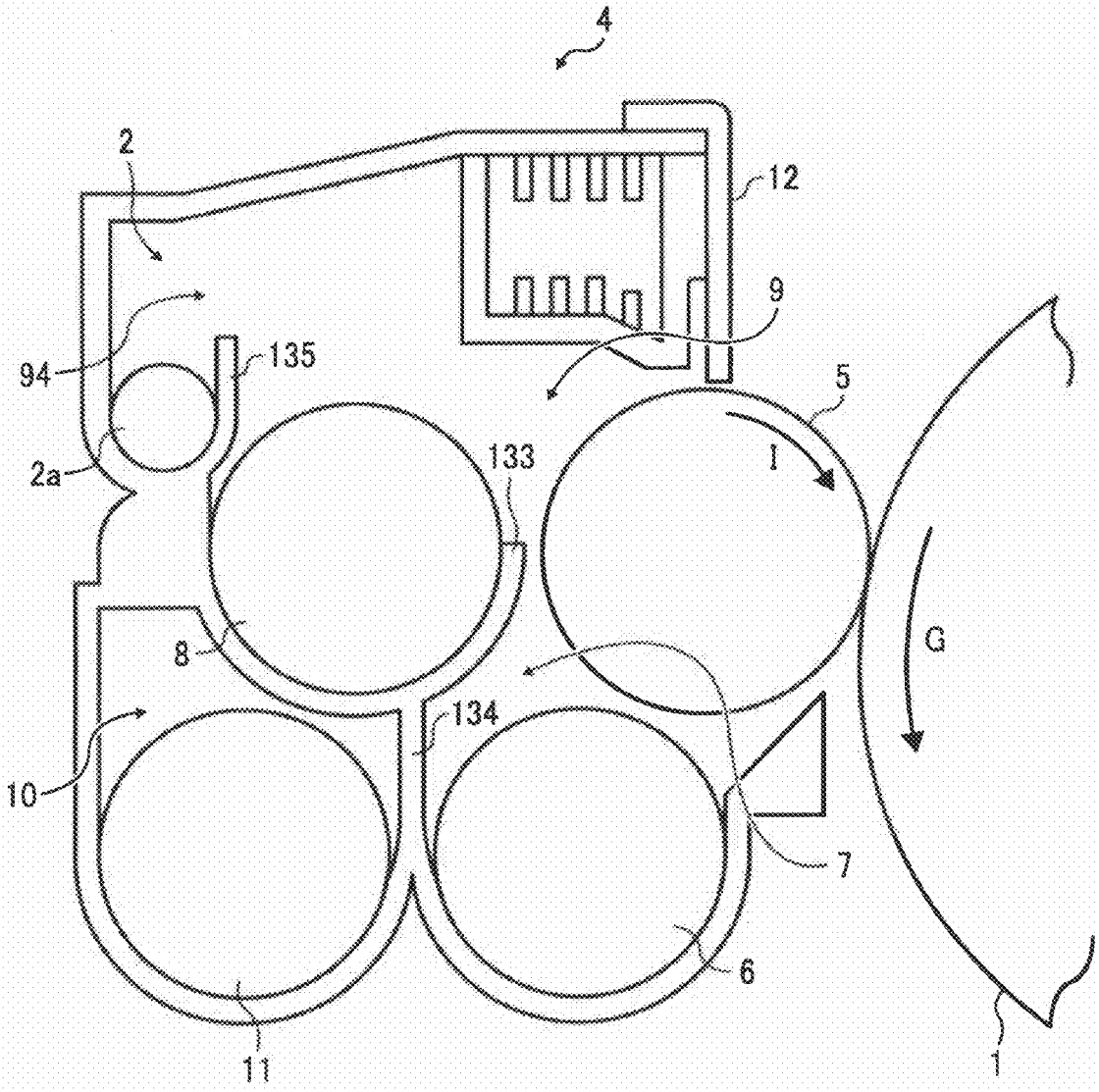
FIG. 4 is a diagram showing the configuration of a developing device and of a photoreceptor of the copying machine.

FIG. 4 is an enlarged configuration diagram showing the developing device 4 equipped in one of the four process cartridges 18Y, M, C and K, and the corresponding photoreceptor 1. Apart from the fact that they handle different colors of toners, the configurations of the four process cartridges 18Y, M, C and K are essentially identical and, accordingly, the letters Y, M, C and K applied to the "4" of the drawing have been omitted.

The surface of the photoreceptor 1 is charged by the charging device, not shown, as it rotates in the direction of the arrow G in the drawing shown in FIG. 4. Toner is supplied from the developing device 4 to a latent image, which is formed as an electrostatic latent image on the charged surface of the photoreceptor 1 by a laser beam irradiated from an exposure device, not shown, whereby a toner image is formed.

The developing device 4 has a developing roller 5 that serves as a developer carrier for supplying the toner to the latent image formed on the surface of the photoreceptor 1 while surface-moving in the direction of the arrow I of the drawing, and thereby developing the latent image. Note that the surface of the developing roller 5 that is made of an Al (aluminum) pipe stock having a diameter of $\phi$25 [mm] has a V-shaped groove or is sandblasted. The size of the gap formed between a developing doctor 12 and the photoreceptor 1 is approximately 0.4 [mm].

The developing device 4 further has a supply screw 8 serving as a supply conveyance member for, while supplying the developer to the developing roller 5, conveying the developer in the direction toward the far side of FIG. 4. The supply screw 8 is a developer conveying screw that has a rotation axis and a wing portion provided on this rotation axis, and conveys the developer in the axial direction by rotating.

The stainless development doctor 12 serving as a developer regulating member for regulating the thickness of the developer supplied to the developing roller 5 to a thickness suitable for development is provided on the downstream side of the developing roller 5 in the direction of surface movement from a part facing the supply screw 8. The developer that is thinned by the developing doctor 12 is conveyed to a developing region facing the photoreceptor 1, to perform development.

A recovery screw 6 serving as a recovery conveyance member for recovering the developer that has passed through the developing region and used for development and then conveying the recovered recovery developer in the same direction as the direction of the supply screw 8 is provided on the downstream side in the surface movement direction from the developing region. A supply conveyance path 9 having the supply screw 8 is disposed in the lateral direction of the developing roller 5, and a recovery conveyance path 7 serving as a recovery conveyance path having the recovery screw 6 is disposed under the developing roller 5.

An agitation conveyance path 10 is provided in the developing device 4 in parallel with the recovery conveyance path 7 under the supply conveyance path 9. The agitation conveyance path 10 has an agitating screw 11 serving as an agitation conveyance member for, while agitating the developer, conveying it in the opposite direction to the direction of the supply screw 8, the opposite direction being oriented on the near side in the drawing.

A first partition wall 133 serving as a partition member partitions between the supply conveyance path 9 and the agitation conveyance path 10. An opening portion is formed in part of the first partition wall 133 that partitions between the supply conveyance path 9 and the agitation conveyance path 10 at both ends in the near side and far side of the drawing, so that the supply conveyance path 9 and the agitation conveyance path 10 are communicated with each other.

Note that the first partition wall 133 also partitions between the supply conveyance path 9 and the recovery conveyance path 7, but there is no opening portion provided in the part of the first partition wall 133 that partitions between the supply conveyance path 9 and the recovery conveyance path 7.

A second partition wall 134 serving as a partition member partitions between the two conveyance paths of the agitation conveyance path 10 and the recovery conveyance path 7. An opening portion is formed in the second partition wall 134 at the near side in the drawing, so that the agitation conveyance path 10 and the recovery conveyance path 7 are communicated with each other.

In addition, in the developing device 4 the supply conveyance path 9, the recovery conveyance path 7 and the agitation conveyance path 10 configure a developer storage for storing the developer.

The developer obtained after development is recovered by the recovery conveyance path 7, conveyed to the near side of the cross section of FIG. 4, and then transported to the agitation conveyance path 10 through the opening portion of the first partition wall 133 provided in a non-image region. It should be noted that toner is replenished from a toner replenishing port provided above the agitation conveyance path 10 to the agitation conveyance path 10, in the vicinity of the opening portion of the first partition wall 133 on the upstream side in the developer conveyance direction in the agitation conveyance path 10.

Next, the circulation of the developer within the three developer conveyance paths will be described.

Figure 5:
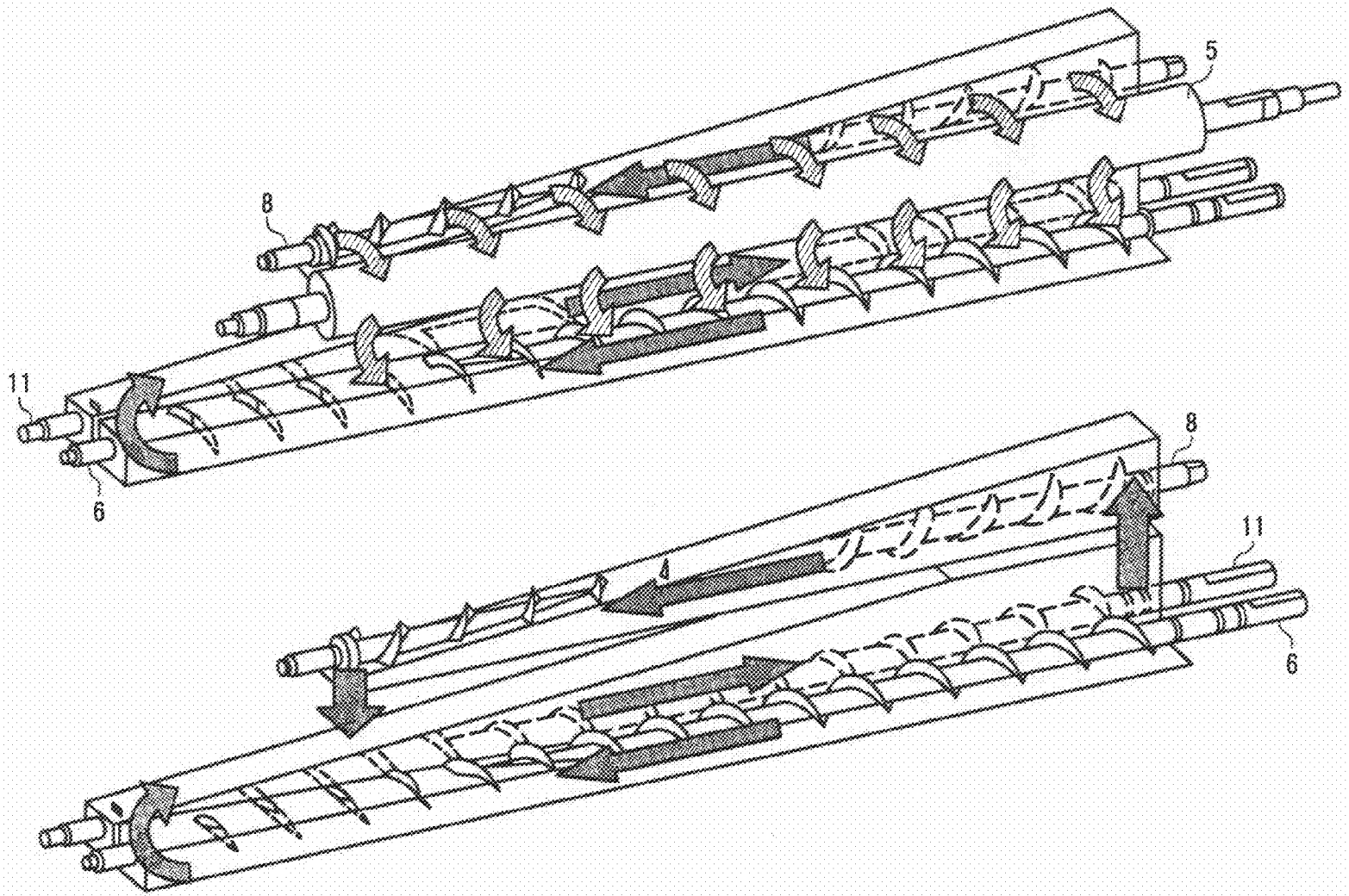
FIG. 5 is a perspective cross-sectional view showing a configuration of the developing device for explaining how a developer flows within developer conveyance paths.
Figure 6:
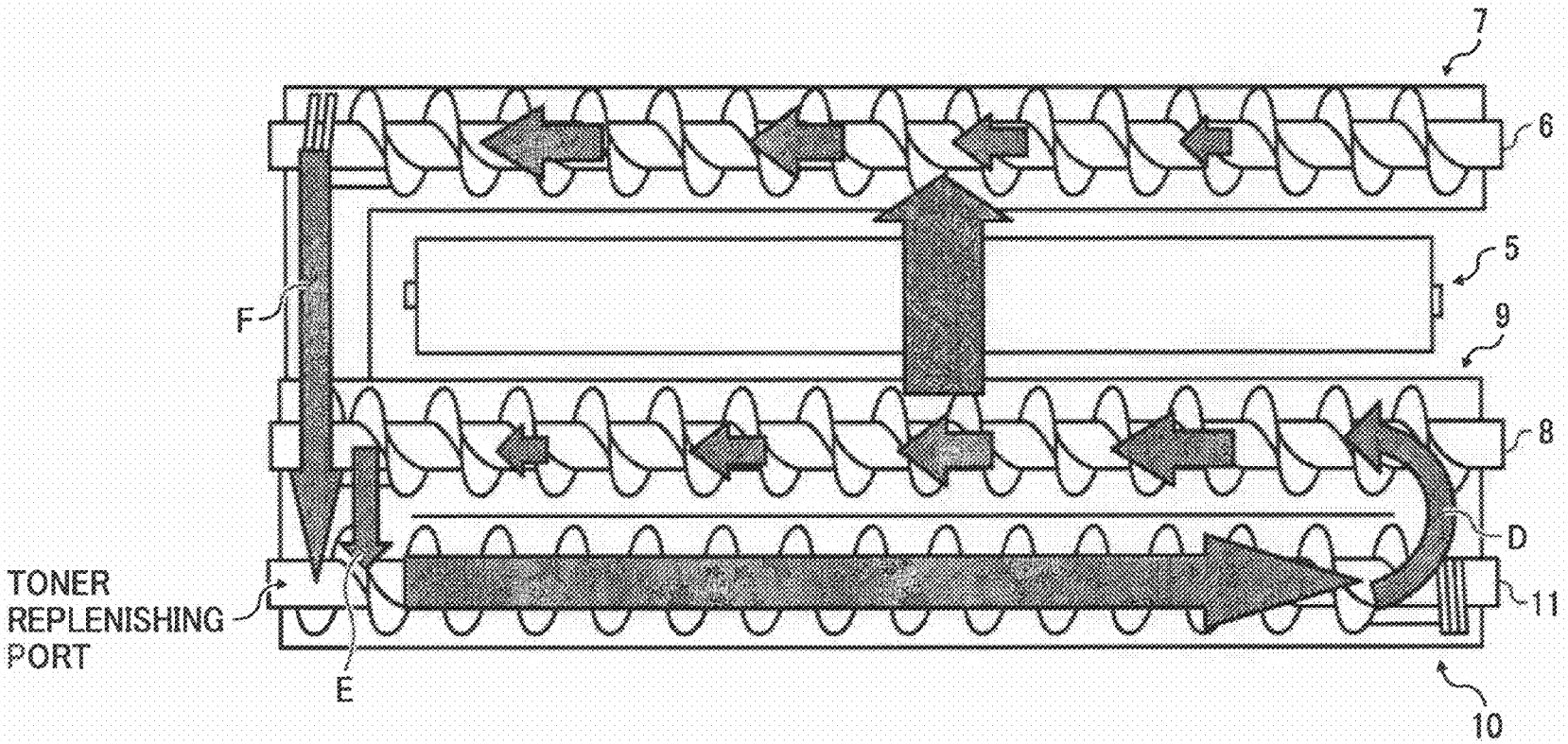
FIG. 6 is a schematic diagram showing how the developer flows within the developing device.

FIG. 5 a perspective cross-sectional view of the developing device 4 for explaining how the developer flows within the developer conveyance paths. In the drawing, the arrows indicate the directions of movement of the developer, and the rectangular solids indicate a distribution of the developer on each screw. Also, FIG. 6 is a schematic diagram showing a flow of the developer within the developing device 4. As with FIG. 5, the arrows in FIG. 6 indicate the directions of movement of the developer.

In the supply conveyance path 9 to which the developer is supplied from the agitation conveyance path 10, the developer is conveyed to the downstream side of the supply screw 8 in the developer conveyance direction, while being supplied to the developing roller 5. Excess developer that is supplied to the developing roller 5 and conveyed to a downstream end of the supply conveyance path 9 in the developer conveyance direction without being used in development is supplied to the agitation conveyance path 10 through an excess opening portion of the first partition wall 133 (arrow E in FIG. 6).

The recovery developer that is sent from the developing roller 5 to the recovery conveyance path 7 and conveyed to the downstream end of the recovery conveyance path 7 in the developer conveyance direction by the recovery screw 6 is supplied to the agitation conveyance path 10 through a recovery opening portion of the second partition wall 134 (arrow F in FIG. 6).

The agitation conveyance path 10 agitates the supplied excess developer and recovery developer, conveys thus obtained mixture to the upstream side of the supply screw 8 in the developer conveyance direction, which constitutes the downstream side of the agitating screw 11 in the developer conveyance direction, and supplies it to the supply conveyance path 9 through a supply opening portion of the first partition wall 133 (arrow D in FIG. 6).

In the agitation conveyance path 10, the recovery developer, excess developer, and pre-mixed toner replenished from the toner replenishing port according to need are agitated and conveyed in the direction opposite to that of the developer of the recovery conveyance path 7 and the supply conveyance path 9, by means of the agitating screw 11. The agitated developer is transported to the upstream side of the supply conveyance path 9 in the developer conveyance direction that is communicated at the downstream side in the conveyance direction. Note that a toner density sensor, not shown, is provided below the agitation conveyance path 10, and a toner replenishing device, which will be described hereinafter in detail, is actuated by the output of the sensor so that the toner is replenished from a toner container.

In the developing device 4 shown in FIG. 4 having the supply conveyance path 9 and the recovery conveyance path 7, because the developer is supplied and recovered in these different developer conveyance paths, the developer used for development is prevented from being mixed in the supply conveyance path 9. Accordingly, the toner density of the developer supplied to the developing roller 5 is prevented from decreasing as the developer moves toward the downstream side of the supply conveyance path 9 in the developer conveyance direction. In addition, because the developing device 4 has the recovery conveyance path 7 and the agitation conveyance path 10 and the developer is recovered and agitated in these different developer conveyance paths, the developer that was used in development is prevented from being lost during the agitation thereof. Accordingly, because the sufficiently agitated developer is supplied to the supply conveyance path 9, the developer can be prevented from being supplied to the supply conveyance path 9 before it is agitated sufficiently. Because the toner density of the developer of the supply conveyance path 9 is prevented from decreasing and insufficient agitation of the developer in the supply conveyance path 9 is prevented in this manner, a constant image density can be ensured throughout development.

Next, characterization portions of the present invention will be described with reference to FIGS. 7 through 10. Note that, unless otherwise stated, the outer diameter, the screw pitch, and the number of threads of the supply screw 8, the recovery screw 6 and the agitating screw 11 serving as the developer conveying members are ϕ22 [mm], 25 [mm], and one, respectively. The rotational speed of each screw is approximately 700 [rpm]. Of course, the outer diameter, the screw pitch, and the number of threads are not limited to the above conditions.

Configuration Example 1

Figure 7:
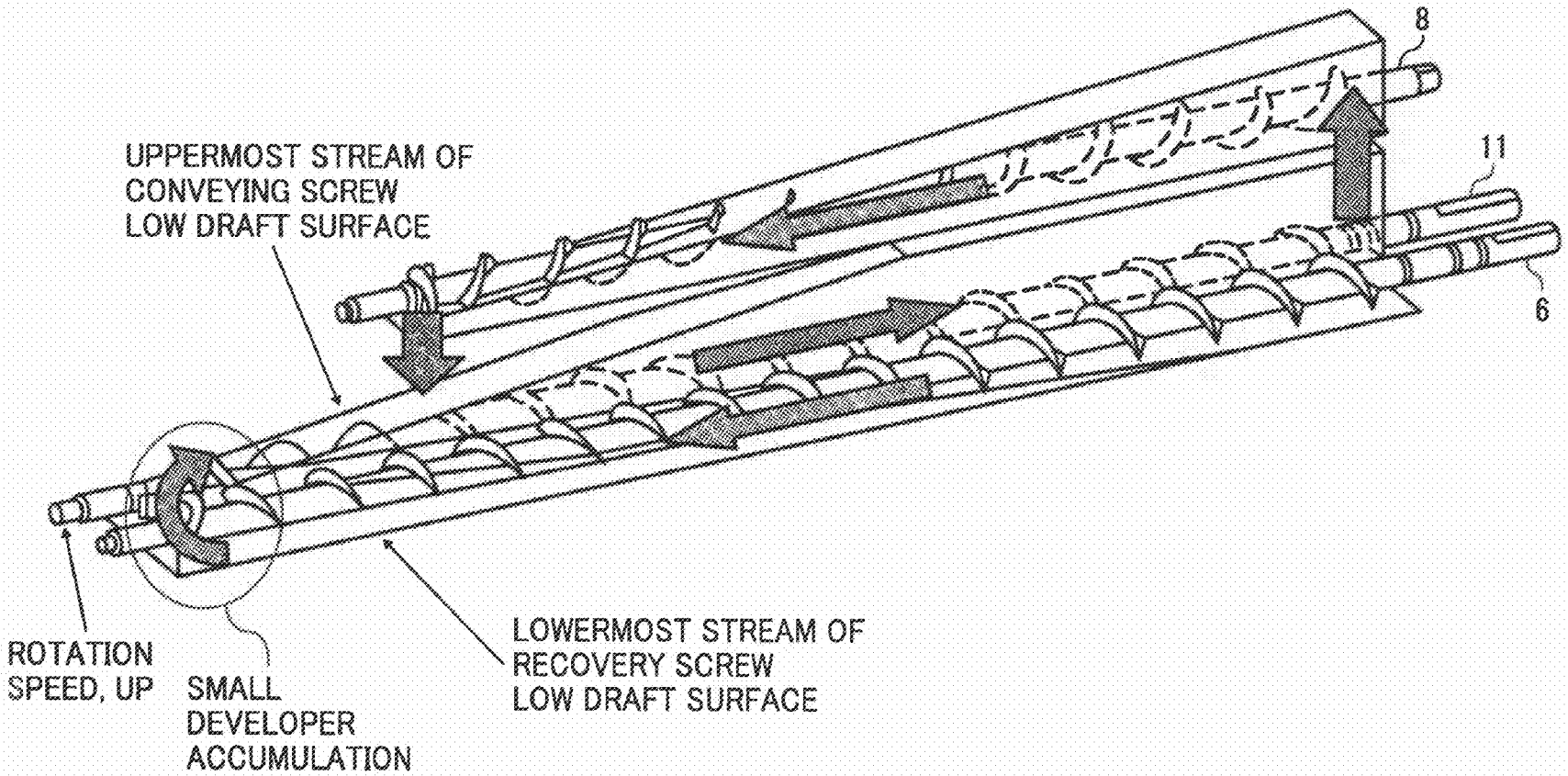
FIG. 7 is a perspective cross-sectional view showing Configuration Example 1 of a developing device that is a characterization portion of the present invention.

In this configuration example, the rotational speed of the supply screw 8 and the recovery screw 6 is approximately 700 [rpm] and the rotational speed of the agitating screw 11 is approximately 730 through 780 [rpm]. Therefore, the agitating screw 11 has a larger amount of developer to convey than the other screws. For this reason, the developer accumulates more on the downstream side of the agitation conveyance path 10 in the developer conveyance direction, and the amount of developer becomes low on the upstream side of the agitation conveyance path 10 in the developer conveyance direction. Consequently, the developer can be delivered smoothly from the lowermost stream side of the recovery conveyance path 7 in the developer conveyance direction to the uppermost stream side of the agitation conveyance path 10 in the developer conveyance direction in a supply amount at which the bulk of the developer does not rise excessively on the downstream side of the recovery conveyance path 7 in the developer conveyance direction. Moreover, the amount of developer accumulated at the downstream of the recovery conveyance path 7 in the developer conveyance direction is reduced. Therefore, as shown in FIG. 7, the bulk of the developer on the downstream side of the recovery screw 6 in the developer conveyance direction becomes low, whereby the so-called accompanying phenomenon in which the recovery developer re-adheres to the developing roller 5 can be prevented from occurring.

Modification1

In addition to the configuration described in Configuration Example 1, a configuration is possible in which the rotational speed of the recovery screw 6 is made substantially equal to the rotational speed of the agitating screw 11. Accordingly, the amount of developer to be conveyed by the recovery screw 6 increases, whereby the amount of recovery developer to be transported from the recovery conveyance path 7 to the agitation conveyance path 10 increases. However, in the configuration of the developing device 4, the developer conveyance amount on the upstream side of the agitation conveyance path 10 in the developer conveyance direction is kept higher than the abovementioned amount of recovery developer to be transported, hence the developer can be delivered smoothly from the lowermost stream side of the recovery conveyance path 7 in the developer conveyance direction to the uppermost stream side of the agitation conveyance path 10 in the developer conveyance direction, and the occurrence of the accompanying phenomenon can be prevented.

Configuration Example 2

In this configuration example, the screw diameter on the upstream side of the agitating screw 11 in the developer conveyance direction is ϕ24 and the screw diameter of the parts other than the upstream side in this developer conveyance direction is ϕ22. Therefore, the agitating screw 11 has a larger amount of developer to convey at the upstream side thereof in the developer conveyance direction than the other screws. For this reason, the developer accumulates more on the downstream side of the agitation conveyance path 10 in the developer conveyance direction, and the amount of developer becomes low on the upstream side of the agitation conveyance path 10 in the developer conveyance direction. Consequently, the developer can be delivered smoothly from the lowermost stream side of the recovery conveyance path 7 in the developer conveyance direction to the uppermost stream side of the agitation conveyance path 10 in the developer conveyance direction in a supply amount at which the bulk of the developer does not rise excessively on the downstream side of the recovery conveyance path 7 in the developer conveyance direction. Moreover, the amount of developer accumulated at the lowermost stream of the recovery conveyance path 7 in the developer conveyance direction is reduced. Therefore, the bulk of the developer on the downstream side of the recovery conveyance path 7 in the developer conveyance direction becomes low, and the occurrence of the accompanying phenomenon can be prevented.

Modification 2

Figure 8:
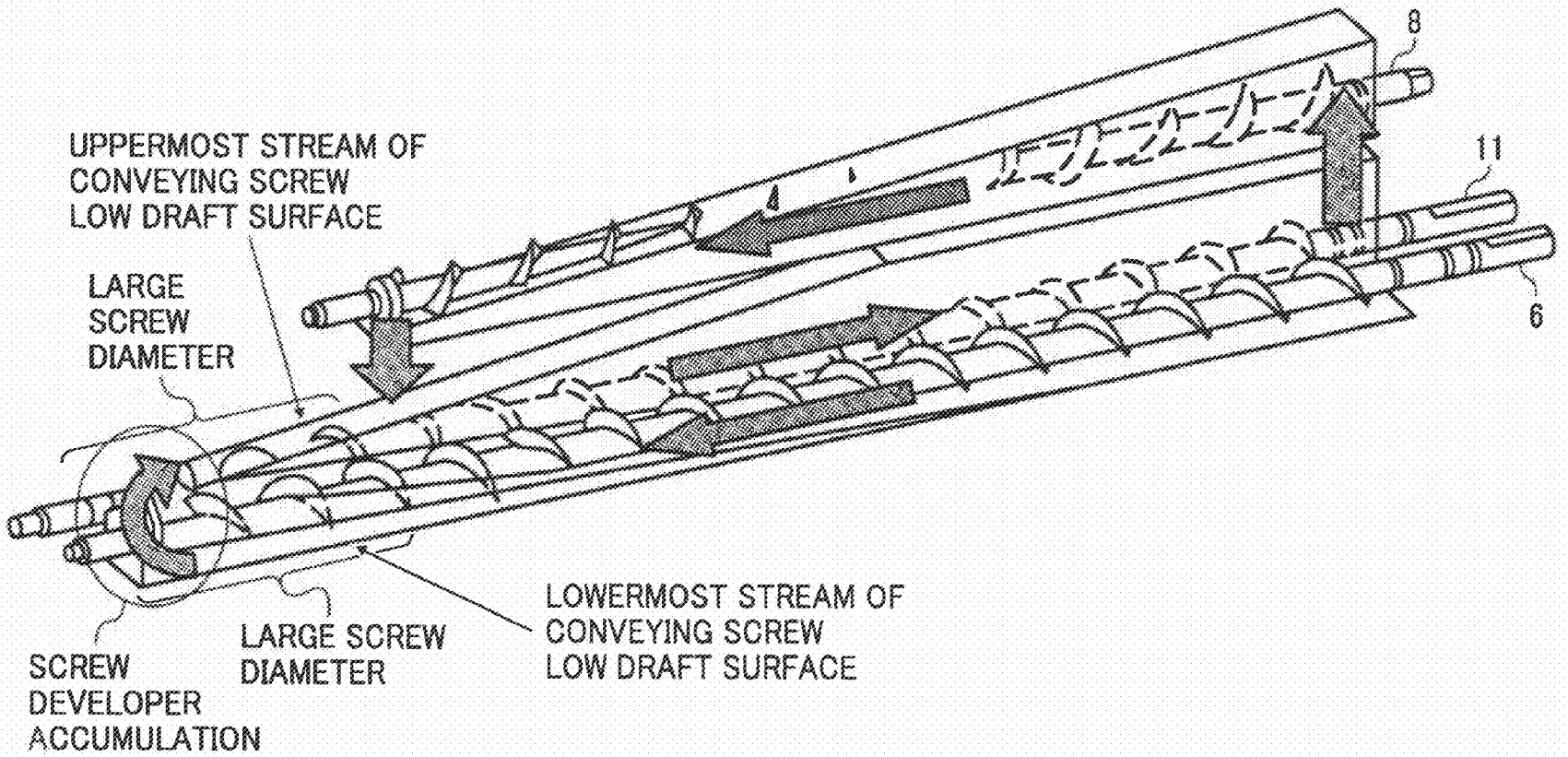
FIG. 8 is a perspective cross-sectional view showing Configuration Example 2 of the developing device that is a characterization portion of the present invention.

In addition to the configuration described in Configuration Example 2, a configuration is possible in which the screw diameter on the downstream side of the recovery screw 6 in the developer conveyance direction is ϕ24 and the screw diameter of the parts other than this downstream side is ϕ22, as shown in FIG. 8. Accordingly, the developer conveyance amount on the downstream side of the recovery screw 6 in the developer conveyance direction increases, whereby the amount of recovery developer to be transported from the recovery conveyance path 7 to the agitation conveyance path 10 increases. However, in the configuration of the developing device 4, the developer conveyance amount on the upstream side of the agitation conveyance path 10 in the developer conveyance direction is kept higher than the abovementioned amount of recovery developer to be transported, hence the developer can be delivered smoothly from the lowermost stream side of the recovery conveyance path 7 in the developer conveyance direction to the uppermost stream side of the agitation conveyance path 10 in the developer conveyance direction, and the occurrence of the accompanying phenomenon can be prevented.

Configuration Example 3

In this configuration example, the screw pitch on the upstream side of the agitating screw 11 in the developer conveyance direction is 30 and the screw pitch of the parts other than the upstream side in this developer conveyance direction is 25. Therefore, the agitating screw 11 has a larger amount of developer to convey at the upstream side thereof in the developer conveyance direction than the other screws. For this reason, the developer accumulates more on the downstream side of the agitation conveyance path 10 in the developer conveyance direction, and the amount of developer becomes low on the upstream side of the agitation conveyance path 10 in the developer conveyance direction. Consequently, the developer can be delivered smoothly from the lowermost stream side of the recovery conveyance path 7 in the developer conveyance direction to the uppermost stream side of the agitation conveyance path 10 in the developer conveyance direction in a supply amount at which the bulk of the developer does not rise excessively on the downstream side of the recovery conveyance path 7 in the developer conveyance direction. Moreover, the amount of developer accumulated at the downstream side of the recovery conveyance path 7 in the developer conveyance direction is reduced. Therefore, the bulk of the developer at the downstream of the recovery conveyance path 7 in the developer conveyance direction becomes low, and the occurrence of the accompanying phenomenon can be prevented.

Modification 3

Figure 9:
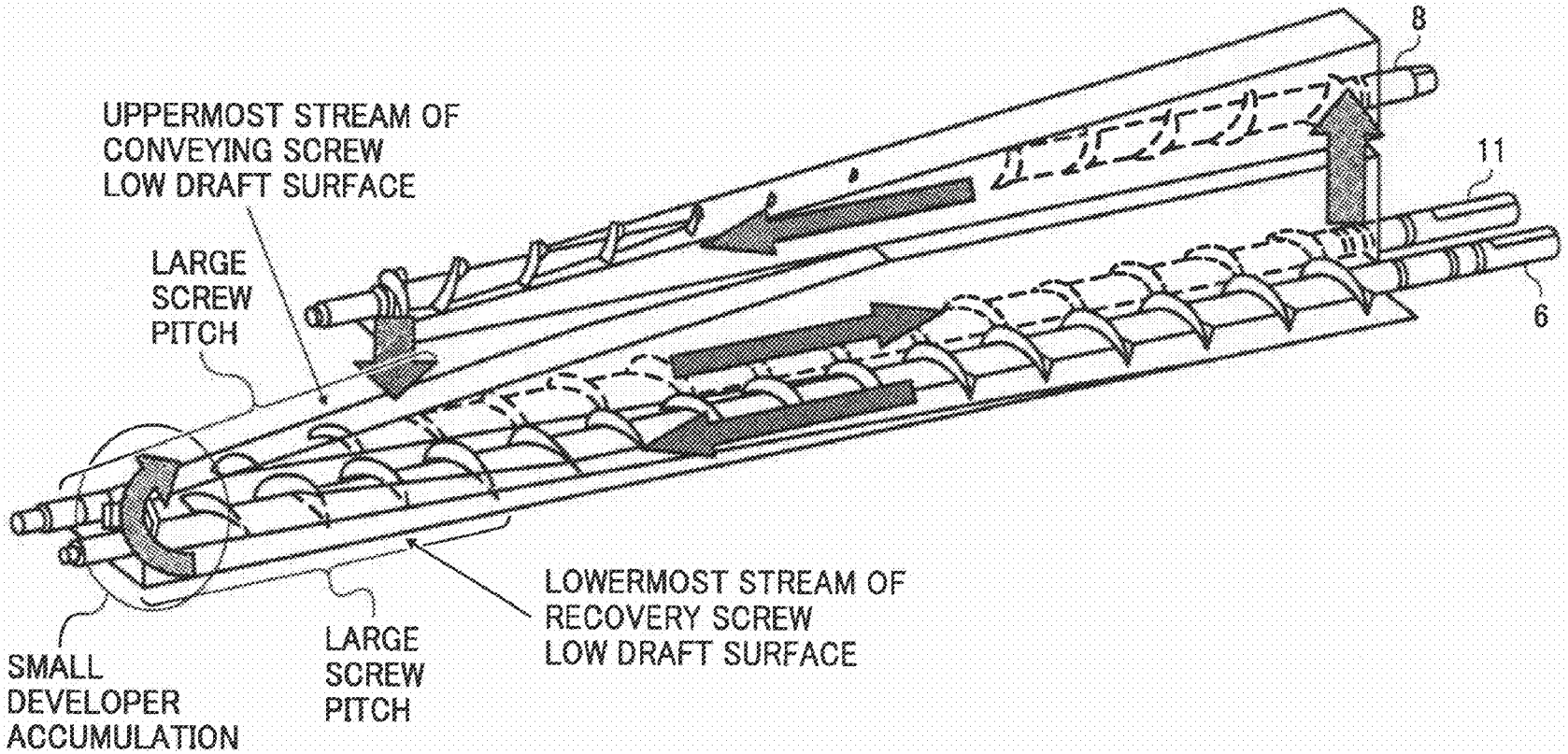
FIG. 9 is a perspective cross-sectional view showing Configuration Example 3 of the developing device that is a characterization portion of the present invention.

In addition to the configuration described in Configuration Example 3, a configuration is possible in which the screw pitch on the downstream side of the recovery screw 6 in the developer conveyance direction is 30 and the screw pitch of the parts other than the downstream side in the developer conveyance direction is 25, as shown in FIG. 9. Accordingly, the developer conveyance amount on the downstream side of the recovery screw 6 in the developer conveyance direction increases, whereby the amount of recovery developer to be transported from the recovery conveyance path 7 to the agitation conveyance path 10 increases. However, in the configuration of the developing device 4, the developer conveyance amount on the upstream side of the agitation conveyance path 10 in the developer conveyance direction is kept higher than the abovementioned amount of recovery developer to be transported, hence the developer can be delivered smoothly from the lowermost stream side of the recovery conveyance path 7 in the developer conveyance direction to the uppermost stream side of the agitation conveyance path 10 in the developer conveyance direction, and the occurrence of the accompanying phenomenon can be prevented.

Configuration Example 4

In this configuration example, the number of threads on the upstream side of the agitating screw 11 in the developer conveyance direction is two and the number of threads at the parts other than the upstream side in this developer conveyance direction is one. Therefore, the agitating screw 11 has a larger amount of developer to convey at the upstream side thereof in the developer conveyance direction than the other screws. For this reason, the developer accumulates more on the downstream side of the agitation conveyance path 10 in the developer conveyance direction, and the amount of developer becomes low on the upstream side of the agitation conveyance path 10 in the developer conveyance direction. Consequently, the developer can be delivered smoothly from the lowermost stream side of the recovery conveyance path 7 in the developer conveyance direction to the uppermost stream side of the agitation conveyance path 10 in the developer conveyance direction in a supply amount at which the bulk of the developer does not rise excessively on the downstream side of the recovery conveyance path 7 in the developer conveyance direction. Moreover, the amount of developer accumulated at downstream of the recovery conveyance path 7 in the developer conveyance direction is reduced. Therefore, the bulk of the developer on the downstream side of the recovery conveyance path 7 in the developer conveyance direction becomes low, and the occurrence of the accompanying phenomenon can be prevented.

Modification 4

Figure 10:
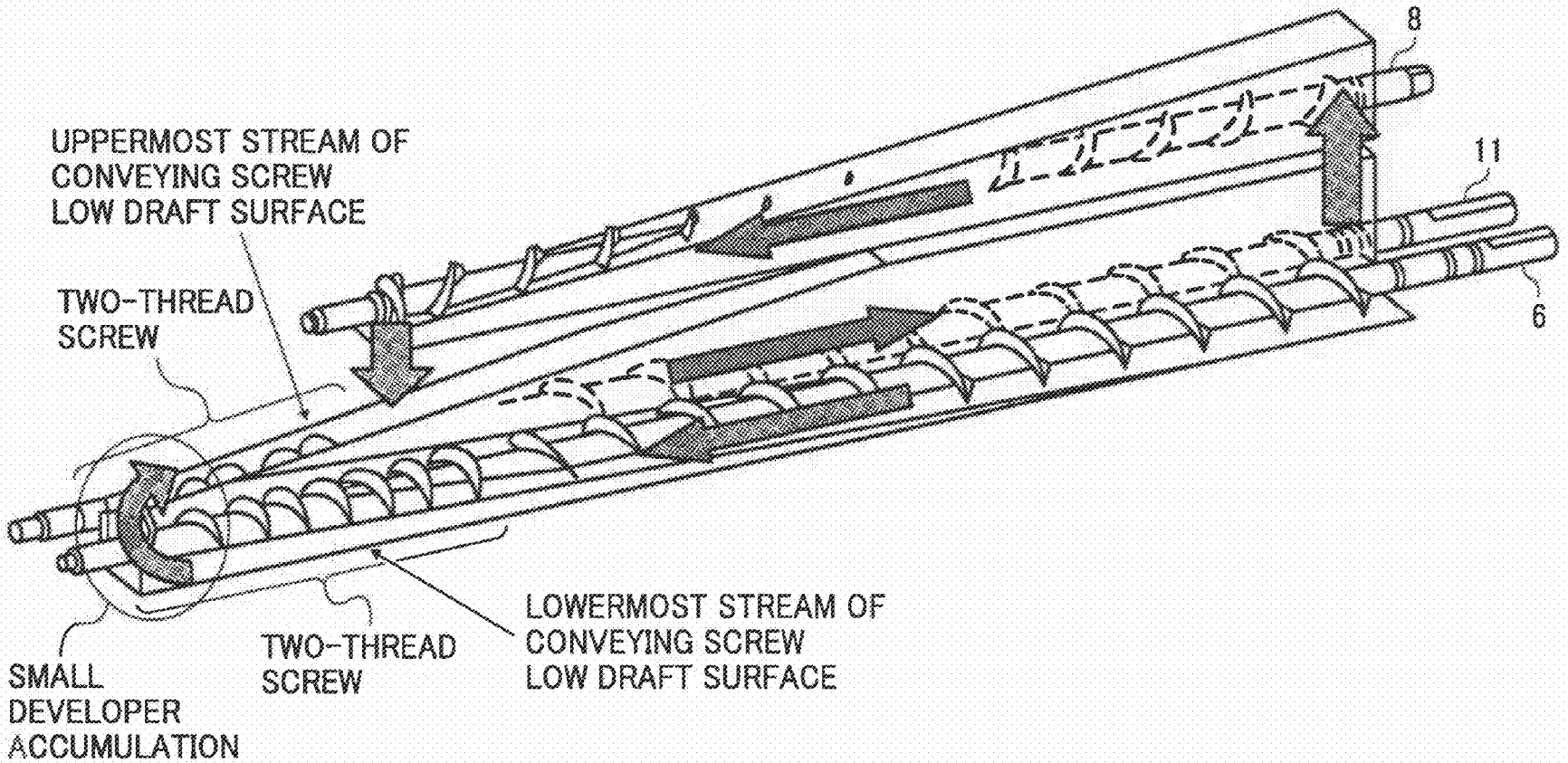
FIG. 10 is a perspective cross-sectional view showing Configuration Example 4 of the developing device that is a characterization portion of the present invention.

In addition to the configuration described in Configuration Example 4, a configuration is possible in which the number of threads on the downstream side of the recovery screw 6 in the developer conveyance direction is two and the number of threads at the parts other than the downstream side in the developer conveyance direction is one, as shown in FIG. 10. Accordingly, the developer conveyance amount on the downstream side of the recovery screw 6 in the developer conveyance direction increases, whereby the amount of recovery developer to be transported from the recovery conveyance path 7 to the agitation conveyance path 10 increases. However, in the configuration of the developing device 4, the developer conveyance amount on the upstream side of the agitation conveyance path 10 in the developer conveyance direction is kept higher than the abovementioned amount of recovery developer to be transported, hence the developer can be delivered smoothly from the lowermost stream side of the recovery conveyance path 7 in the developer conveyance direction to the uppermost stream side of the agitation conveyance path 10 in the developer conveyance direction, and the occurrence of the accompanying phenomenon can be prevented.

As described above, according to the present embodiment, in the developing device 4 having: the developing roller 5 serving as a developer carrier, which rotates while carrying a two-component developer composed of a toner and a magnetic carrier on a surface of the developing roller 5, supplies the toner to a latent image on a surface of the photoreceptor 1 serving as a latent image carrier at a section where the developing roller 5 faces the photoreceptor 1, and develops the latent image; the supply conveyance path 9 serving as a developer supply conveyance path, which conveys the developer in a direction of axis of the developing roller 5 and is provided with the supply screw 8 serving as a developer supply conveyance screw for supplying the developer to the developing roller 5; the recovery conveyance path 7 serving as a developer recovery conveyance path, which has the recovery screw 6 serving as a developer recovery conveyance screw for conveying the developer recovered from the developing roller 5 after passing through the section where the developing roller 5 faces the photoreceptor 1, in the direction of axis of the developing roller 5 and in the same direction as the direction of the supply screw 8; and the agitation conveyance path 10 serving as a developer agitation conveyance path, which has the agitating screw 11 serving as a developer agitation conveyance screw for receiving a supply of an excess developer conveyed to the lowermost stream side of the supply conveyance path 9 in the developer conveyance direction without being used in development, and a recovery developer recovered from the developing roller 5 and conveyed to the lowermost stream side of the recovery conveyance path 7 in the developer conveyance direction, and conveying the excess developer and the recovery developer in the direction of axis of the developing roller 5 and in a direction opposite to the direction of the supply screw 8 while agitating the excess developer and the recovery developer, and which supplies the developer to the supply conveyance path 9, the agitation conveyance path 10 and the recovery conveyance path 7 being provided in parallel with each other on substantially the same level and the supply conveyance path 9 being provided so as to be positioned above the other two developer conveyance paths, wherein the developer conveyance amount on the upstream side of the conveying screw 11 in the developer conveyance direction is equal to or larger than the developer conveyance amount on the downstream side of the recovery screw 6 in the developer conveyance direction. Accordingly, the amount of developer to be transported from the recovery conveyance path 7 to the agitation conveyance path 10 can be made larger than the developer conveyance amount on the upstream side of the agitation conveyance path 10 in the developer conveyance direction. Therefore, because the amount of developer existing on the upstream side of the agitation conveyance path 10 in the developer conveyance direction becomes low, the developer can be delivered smoothly from the downstream side of the recovery conveyance path 7 in the developer conveyance direction to the upstream side of the agitation conveyance path 10 in the developer conveyance direction. Consequently, since the bulk of the developer existing on the downstream side of the recovery conveyance path 7 in the developer conveyance direction can be prevented from exceeding the level where recovery developer re-adheres to the developing roller 5, the developer existing on the downstream side of the recovery conveyance path 7 in the developer conveyance direction can be prevented from re-adhering to the developing roller 5. Therefore, the developing roller 5 can develop the latent image formed on the photoreceptor 1 by using only the developer supplied from the supply conveyance path 9, and the latent image can be developed only by the developer having an appropriate toner density without allowing the recovered developer to re-adhere to the developing roller 5, hence good image quality can be maintained.

Moreover, according to the present embodiment, the rotational speed of the agitating screw 11 is made higher than at least the rotational speed of the recovery screw 6, whereby the amount of developer to be conveyed by the agitating screw 11 can be made larger than the amount of developer to be supplied from the lowermost stream side of the recovery conveyance path 7 in the developer conveyance direction to the uppermost stream side of the agitation conveyance path 10 in the developer conveyance direction, and the amount of developer existing on the upstream side of the agitation conveyance path 10 in the developer conveyance direction can be reduced. Accordingly, the developer can be delivered smoothly from the lowermost stream side of the recovery conveyance path 7 in the developer conveyance direction to the uppermost stream side of the agitation conveyance path 10 in the developer conveyance direction, and the amount of developer accumulated on the downstream side of the recovery conveyance path 7 in the developer conveyance direction can be reduced. Consequently, the bulk of the developer becomes lower than the abovementioned level at the downstream side of the recovery screw 6 in the developer conveyance direction, and the occurrence of the accompanying phenomenon can be prevented.

According to the present embodiment, by making the rotational speed of the recovery screw 6 higher than the rotational speed of the supply screw 8, i.e., by increasing the rotational speed of the recovery screw 6 as well as the rotational speed of the agitating screw 7, the amount of developer to be conveyed by the recovery screw 6 increases when the rotational speed of the recovery screw 6, for example, is increased to substantially the same rotational speed as that of the agitating screw 11, whereby the amount of recovery developer to be transported from the recovery conveyance path 7 to the agitation conveyance path 10 increases. However, in the configuration of the developing device 4, the developer conveyance amount on the upstream side of the agitation conveyance path 10 in the developer conveyance direction is kept higher than the abovementioned amount of recovery developer to be transported, hence the developer can be delivered smoothly from the lowermost stream side of the recovery conveyance path 7 in the developer conveyance direction to the uppermost stream side of the agitation conveyance path 10 in the developer conveyance direction, and the occurrence of the accompanying phenomenon can be prevented.

Furthermore, according to the present embodiment, the outer diameter of the agitating screw 11 at the upstream side in the developer conveyance direction is made larger than the outer diameter of the recovery screw 6, whereby the amount of developer conveyed by the agitating screw 11 is made larger than the amount of developer to be supplied from the lowermost stream side of the recovery conveyance path 7 in the developer conveyance direction to the uppermost stream side of the agitation conveyance path 10 in the developer conveyance direction, so that the amount of developer existing on the upstream side of the agitation conveyance path 10 in the developer conveyance direction can be reduced. Accordingly, the developer can be delivered smoothly from the lowermost stream side of the recovery conveyance path 7 in the developer conveyance direction to the uppermost stream side of the agitation conveyance path 10 in the developer conveyance direction, and the amount of developer accumulated on the downstream side of the recovery conveyance path 7 in the developer conveyance direction can be reduced. Consequently, the bulk of the developer becomes lower than the abovementioned level at the downstream side of the recovery screw 6 in the developer conveyance direction, and the occurrence of the accompanying phenomenon can be prevented.

According to the present embodiment, the outer diameter of the agitating screw 11 at the upstream side thereof in the developer conveyance direction and the outer diameter of the recovery screw 6 at the downstream side thereof in the developer conveyance direction are made larger than the outer diameter of a part of at least the recovery screw 6 at a section other than the downstream side of the recovery screw 6 in the developer conveyance direction, whereby the developer conveyance amount on the upstream side of the agitating screw 11 in the developer conveyance direction and the developer conveyance amount on the downstream side of the recovery screw 6 in the developer conveyance direction increase, so that the amount of recovery developer to be transported from the recovery conveyance path 7 to the agitation conveyance path 10 increases. However, in the configuration of the developing device 4, the developer conveyance amount on the upstream side of the agitation conveyance path 10 in the developer conveyance direction is kept higher than the abovementioned amount of recovery developer to be transported, hence the developer can be delivered smoothly from the lowermost stream side of the recovery conveyance path 7 in the developer conveyance direction to the uppermost stream side of the agitation conveyance path 10 in the developer conveyance direction, and the occurrence of the accompanying phenomenon can be prevented.

According to the present embodiment, the screw pitch of the agitating screw 11 at the upstream side in the developer conveyance direction is made larger than the screw pitch of the recovery screw 6, whereby the amount of developer conveyed by the agitating screw 11 is made larger than the amount of developer to be supplied from the lowermost stream side of the recovery conveyance path 7 in the developer conveyance direction to the uppermost stream side of the agitation conveyance path 10 in the developer conveyance direction, so that the amount of developer existing on the upstream side of the agitation conveyance path 10 in the developer conveyance direction can be reduced. Accordingly, the developer can be delivered smoothly from the lowermost stream side of the recovery conveyance path 7 in the developer conveyance direction to the uppermost stream side of the agitation conveyance path 10 in the developer conveyance direction, and the amount of developer accumulated on the downstream side of the recovery conveyance path 7 in the developer conveyance direction can be reduced. Consequently, the bulk of the developer becomes lower than the abovementioned level at the downstream side of the recovery screw 6 in the developer conveyance direction, and the occurrence of the accompanying phenomenon can be prevented.

According to the present embodiment, the screw pitch of the agitating screw 11 at the upstream side thereof in the developer conveyance direction and the screw pitch of the recovery screw 6 at the downstream side thereof in the developer conveyance direction are made larger than the screw pitch of a part of at least the recovery screw 6 at a section other than the downstream side of the recovery screw 6 in the developer conveyance direction, whereby the developer conveyance amount on the upstream side of the agitating screw 11 in the developer conveyance direction and the developer conveyance amount on the downstream side of the recovery screw 6 in the developer conveyance direction increase, so that the amount of recovery developer to be transported from the recovery conveyance path 7 to the agitation conveyance path 10 increases. However, in the configuration of the developing device 4, the developer conveyance amount on the upstream side of the agitation conveyance path 10 in the developer conveyance direction is kept higher than the abovementioned amount of recovery developer to be transported, hence the developer can be delivered smoothly from the lowermost stream side of the recovery conveyance path 7 in the developer conveyance direction to the uppermost stream side of the agitation conveyance path 10 in the developer conveyance direction, and the occurrence of the accompanying phenomenon can be prevented.

Furthermore, according to the present embodiment, the number of threads of the agitating screw 11 at the upstream side in the developer conveyance direction is made larger than the number of threads of the recovery screw 6, whereby the amount of developer conveyed by the agitating screw 11 is made larger than the amount of developer to be supplied from the lowermost stream side of the recovery conveyance path 7 in the developer conveyance direction to the uppermost stream side of the agitation conveyance path 10 in the developer conveyance direction, so that the amount of developer existing on the upstream side of the agitation conveyance path 10 in the developer conveyance direction can be reduced. Accordingly, the developer can be delivered smoothly from the lowermost stream side of the recovery conveyance path 7 in the developer conveyance direction to the uppermost stream side of the agitation conveyance path 10 in the developer conveyance direction, and the amount of developer accumulated on the downstream side of the recovery conveyance path 7 in the developer conveyance direction can be reduced. Consequently, the bulk of the developer becomes lower than the abovementioned level at the downstream side of the recovery screw 6 in the developer conveyance direction, and the occurrence of the accompanying phenomenon can be prevented.

According to the present embodiment, the number of threads of the agitating screw 11 at the upstream side thereof in the developer conveyance direction and the number of threads of the recovery screw 6 at the downstream side thereof in the developer conveyance direction are made larger than the number of threads of a part of at least the recovery screw 6 at a section other than the downstream side of the recovery screw 6 in the developer conveyance direction, whereby the developer conveyance amount on the upstream side of the agitating screw 11 in the developer conveyance direction and the developer conveyance amount on the downstream side of the recovery screw 6 in the developer conveyance direction increase, so that the amount of recovery developer to be transported from the recovery conveyance path 7 to the agitation conveyance path 10 increases. However, in the configuration of the developing device 4, the developer conveyance amount on the upstream side of the agitation conveyance path 10 in the developer conveyance direction is kept higher than the abovementioned amount of recovery developer to be transported, hence the developer can be delivered smoothly from the lowermost stream side of the recovery conveyance path 7 in the developer conveyance direction to the uppermost stream side of the agitation conveyance path 10 in the developer conveyance direction, and the occurrence of the accompanying phenomenon can be prevented.

In addition, according to the present embodiment, in the copying machine that serves as an image forming apparatus having the photoreceptor 1 and the developing means for using a developer to developer a latent image on the photoreceptor 1, the developing device of the present invention is used as the developing means so that the developer that has been recovered by the recovery conveyance path 7 does not re-adhere to the developing roller 5, whereby a high-quality image can be formed.

Note that, in the present embodiment, the developing device that has, individually, the characteristic configurations described in the respective configuration examples and modifications (the rotational speed of each screw, the outer diameter of each screw, the screw pitch of each screw, and the number of threads of each screw) was described as the configuration of the developing device 4 that prevents the occurrence of the accompanying phenomenon in which the developer recovered by the recovery conveyance path 7 re-adheres to the developing roller 5. However, the present invention is not limited to this embodiment. A synergetic effect can be obtained by combining these characteristic configurations described in the respective configuration examples and modifications so that the occurrence of the accompanying phenomenon can be further prevented. Moreover, it is sufficient that the developer conveyance amount on the upstream side of the agitating screw 11 in the developer conveyance direction is equal to or larger than the developer conveyance amount on the downstream side of the recovery screw 6 in the developer conveyance direction, but the amount of developer existing on the upstream side of the agitation conveyance path 10 in the developer conveyance direction can be further reduced by making the developer conveyance amount of the agitating screw 11 larger than the developer conveyance amount of the recovery screw 6. Therefore, when a latent image with a small image area ratio is developed and the amount of developer to be recovered by the recovery conveyance path 7 is large, the developer can be delivered smoothly from the downstream side of the recovery conveyance path 7 in the developer conveyance direction to the upstream side of the agitation conveyance path 10 in the developer conveyance direction.

As described above, the present invention has an excellent effect of preventing deterioration of the image quality, which is caused when the recovered developer re-adheres to the developer carrier.

Various modifications will become possible for those skilled in the art after receiving the teachings of the present disclosure without departing from the scope thereof.

What is claimed is:

1. A developing device, comprising:

a developer carrier, which rotates while carrying a two-component developer composed of a magnetic carrier and a toner on a surface of the developer carrier, supplies the toner to a latent image on a surface of a latent image carrier at a section where the developer carrier faces the latent image carrier, and develops the latent image;

a developer supply conveyance path, which conveys the developer in a direction of axis of the developer carrier and is provided with a developer supply conveyance screw for supplying the developer to the developer carrier;

a developer recovery conveyance path, which has a developer recovery conveyance screw for conveying the developer recovered from the developer carrier after passing through the section where the developer carrier faces the latent image carrier, in the direction of axis of the developer carrier and in the same direction as a direction of the developer supply conveyance screw; and a developer agitation conveyance path, which supplies the developer to the developer supply conveyance path and which has a developer agitation conveyance screw for receiving a supply of an excess developer conveyed to the lowermost stream side of the developer supply conveyance path in a developer conveyance direction without being used in development, and a recovery developer recovered from the developer carrier and conveyed to the lowermost stream side of the developer recovery conveyance path in the developer conveyance direction, and conveying the excess developer and the recovery developer in the direction of axis of the developer carrier and in a direction opposite to the direction of the developer supply conveyance screw while agitating the excess developer and the recovery developer, wherein the developer conveyance amount on the upstream side of the developer agitation conveyance screw in the developer conveyance direction is equal to or larger than the developer conveyance amount on the downstream side of the developer recovery conveyance screw in the developer conveyance direction, wherein a rotational speed of the developer agitation conveyance screw is higher than a rotational speed of at least the developer recovery conveyance screw.

2. The developing device as claimed in claim 1, wherein the rotational speed of the developer recovery conveyance screw is higher than a rotational speed of the developer supply conveyance screw.

3. An image forming apparatus, comprising:

a latent image carrier that carries a latent image; and developing means for developing the latent image on the latent image carrier by means of a developer, wherein the developing means comprises:

a developer carrier, which rotates while carrying a two-component developer composed of a magnetic carrier and a toner on a surface of the developer carrier, supplies the toner to the latent image on a surface of the latent image carrier at a section where the developer carrier faces the latent image carrier, and develops the latent image;

a developer supply conveyance path, which conveys the developer in a direction of axis of the developer carrier and is provided with a developer supply conveyance screw for supplying the developer to the developer carrier;

a developer recovery conveyance path, which has a developer recovery conveyance screw for conveying the developer recovered from the developer carrier after passing through the section where the developer carrier faces the latent image carrier, in the direction of axis of the developer carrier and in the same direction as a direction of the developer supply conveyance screw; and a developer agitation conveyance path, which supplies the developer to the developer supply conveyance path and which has a developer agitation conveyance screw for receiving a supply of an excess developer conveyed to the lowermost stream side of the developer supply conveyance path in a developer conveyance direction without being used in development, and a recovery developer recovered from the developer carrier and conveyed to the lowermost stream side of the developer recovery conveyance path in the developer conveyance direction, and conveying the excess developer and the recovery developer in the direction of axis of the developer carrier and in a direction opposite to the direction of the developer supply conveyance screw while agitating the excess developer and the recovery developer, the developer conveyance amount on the upstream side of the developer agitation conveyance screw in the developer conveyance direction being equal to or larger than the developer conveyance amount on the downstream side of the developer recovery conveyance screw in the developer conveyance direction, wherein the developer agitation conveyance path and the developer recovery conveyance path are provided in parallel with each other on substantially the same level, the developer supply conveyance path is provided so as to be positioned above the other two developer conveyance paths.

4. A developing device, comprising:

a developer carrier, which rotates while carrying a two-component developer composed of a magnetic carrier and a toner on a surface of the developer carrier, supplies the toner to a latent image on a surface of a latent image carrier at a section where the developer carrier faces the latent image carrier, and develops the latent image;

a developer supply conveyance path, which conveys the developer in a direction of axis of the developer carrier and is provided with a developer supply conveyance screw for supplying the developer to the developer carrier;

a developer recovery conveyance path, which has a developer recovery conveyance screw for conveying the developer recovered from the developer carrier after passing through the section where the developer carrier faces the latent image carrier, in the direction of axis of the developer carrier and in the same direction as a direction of the developer supply conveyance screw; and a developer agitation conveyance path, which supplies the developer to the developer supply conveyance path and which has a developer agitation conveyance screw for receiving a supply of an excess developer conveyed to the lowermost stream side of the developer supply conveyance path in a developer conveyance direction without being used in development, and a recovery developer recovered from the developer carrier and conveyed to the lowermost stream side of the developer recovery conveyance path in the developer conveyance direction, and conveying the excess developer and the recovery developer in the direction of axis of the developer carrier and in a direction opposite to the direction of the developer supply conveyance screw while agitating the excess developer and the recovery developer, wherein the developer conveyance amount on the upstream side of the developer agitation conveyance screw in the developer conveyance direction is equal to or larger than the developer conveyance amount on the downstream side of the developer recovery conveyance screw in the developer conveyance direction, wherein the developer agitation conveyance path and the developer recovery conveyance path are provided in parallel with each other on substantially the same level, the developer supply conveyance path is provided so as to be positioned above the other two developer conveyance paths.

5. An image forming apparatus, comprising:

a latent image carrier that carries a latent image; and developing means for developing the latent image on the latent image carrier by means of a developer, wherein the developing means comprises:

a developer carrier, which rotates while carrying a two-component developer composed of a magnetic carrier and a toner on a surface of the developer carrier, supplies the toner to the latent image on a surface of the latent image carrier at a section where the developer carrier faces the latent image carrier, and develops the latent image;

a developer supply conveyance path, which conveys the developer in a direction of axis of the developer carrier and is provided with a developer supply conveyance screw for supplying the developer to the developer carrier;

a developer recovery conveyance path, which has a developer recovery conveyance screw for conveying the developer recovered from the developer carrier after passing through the section where the developer carrier faces the latent image carrier, in the direction of axis of the developer carrier and in the same direction as a direction of the developer supply conveyance screw; and a developer agitation conveyance path, which supplies the developer to the developer supply conveyance path and which has a developer agitation conveyance screw for receiving a supply of an excess developer conveyed to the lowermost stream side of the developer supply conveyance path in a developer conveyance direction without being used in development, and a recovery developer recovered from the developer carrier and conveyed to the lowermost stream side of the developer recovery conveyance path in the developer conveyance direction, and conveying the excess developer and the recovery developer in the direction of axis of the developer carrier and in a direction opposite to the direction of the developer supply conveyance screw while agitating the excess developer and the recovery developer, the developer conveyance amount on the upstream side of the developer agitation conveyance screw in the developer conveyance direction being equal to or larger than the developer conveyance amount on the downstream side of the developer recovery conveyance screw in the developer conveyance direction, wherein a rotational speed of the developer agitation conveyance screw is higher than a rotational speed of at least the developer recovery conveyance screw.

6. The image forming apparatus as claimed in claim 5, wherein the rotational speed of the developer recovery conveyance screw is higher than a rotational speed of the developer supply conveyance screw.

* * * * *